US005860251A

United States Patent [19]

Gleich

[11] Patent Number: 5,860,251

[45] Date of Patent: Jan. 19, 1999

[54] RAPIDLY DEPLOYABLE FIRE-PROTECTION APPARATUS

[76] Inventor: Joseph Gleich, P.O. Box 3663, Rancho Santa Fe, Calif. 92067

[21] Appl. No.: 601,328

[22] Filed: Feb. 16, 1996

[51] Int. Cl.[6] ..... E04H 9/16; A62C 3/00

[52] U.S. Cl. ..... 52/2.25; 52/2.18; 52/2.22; 52/4; 52/DIG. 14

[58] Field of Search ..... 52/1, 2.11, 2.18, 52/2.22, 2.23, 2.24, 2.25, 2.26, 3, 5, DIG. 12, DIG. 14, 4; 135/98, 124, 125, 126, 115, 118, 119, 19.5, 20.2; 169/48, 51

[56] References Cited

U.S. PATENT DOCUMENTS

| | | | |
|---|---|---|---|
| 2,365,127 | 12/1944 | Wagner . | |
| 2,651,314 | 9/1953 | Hasselquist | 52/2.22 |
| 3,333,595 | 8/1967 | Bannister | 135/98 |
| 3,687,185 | 8/1972 | Singer . | |
| 3,715,843 | 2/1973 | Ballinger | 52/3 |
| 3,766,958 | 10/1973 | Mitchell . | |
| 4,004,380 | 1/1977 | Kwake | 52/2.18 |
| 4,858,395 | 8/1989 | McQuirk . | |
| 5,123,434 | 6/1992 | Fetterly | 135/20.2 |
| 5,423,150 | 6/1995 | Hitchcock | 52/3 |

FOREIGN PATENT DOCUMENTS

| | | | |
|---|---|---|---|
| 1282385 | 12/1961 | France | 52/2.22 |

OTHER PUBLICATIONS

Herzog, *Pneumatic Structures, Oxford University Press*, 1976; pp.:142–144; 167.

DiChristina, *Home Newsfront: Flights from Terra Firma*, Popular Science, Mar. 1993, p. 39.

*Primary Examiner*—Michael Safavi
*Attorney, Agent, or Firm*—Henri J.A. Charmasson; John D. Buchaca

[57] ABSTRACT

Fire-resistant flexible dome (2) apparatus for covering and protecting buildings (6), goods, livestock, persons and other objects from a fire, especially a rapidly moving conflagration known as a "fire storm." In its preferred form, the apparatus comprises a dome-like structure (2) made of fire-retardant fabric, supported with air or gas pressure within integral tubes (40) radially disposed about the central axis, or between one or more layers of said fire resistant fabric. Said apparatus is rapidly deployed from its container (4), preferably located on the roof of the building (6) to be protected. Its ground-contacting periphery (13) is manually secured to the ground. In one embodiment, a liquid-filled circumferencial reservoir (24) integral with said ground-contacting periphery is provided to add an improved ground seal and added anchoring to ground to help maintain structural integrity. Air or gas pressure may be provided by several means including compressed gas, mechanical air movement or chemical devolution. The arcuate surface of the structure (2) permits laminar flow of air over the surface to aid in minimizing the effect of super-heated air, flame and burning debris upon the structure (6).

12 Claims, 6 Drawing Sheets

Fig. 8B
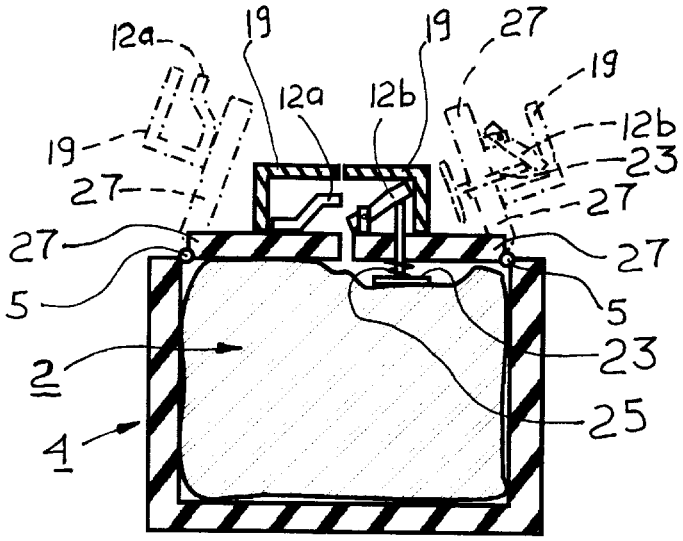
Fig. 10
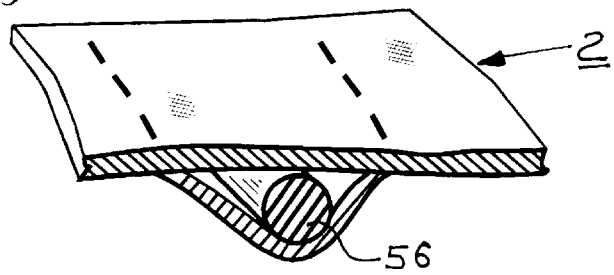
Fig. 12
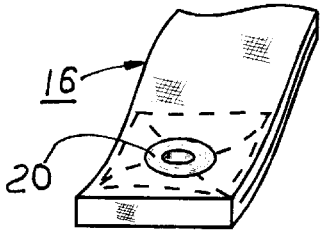
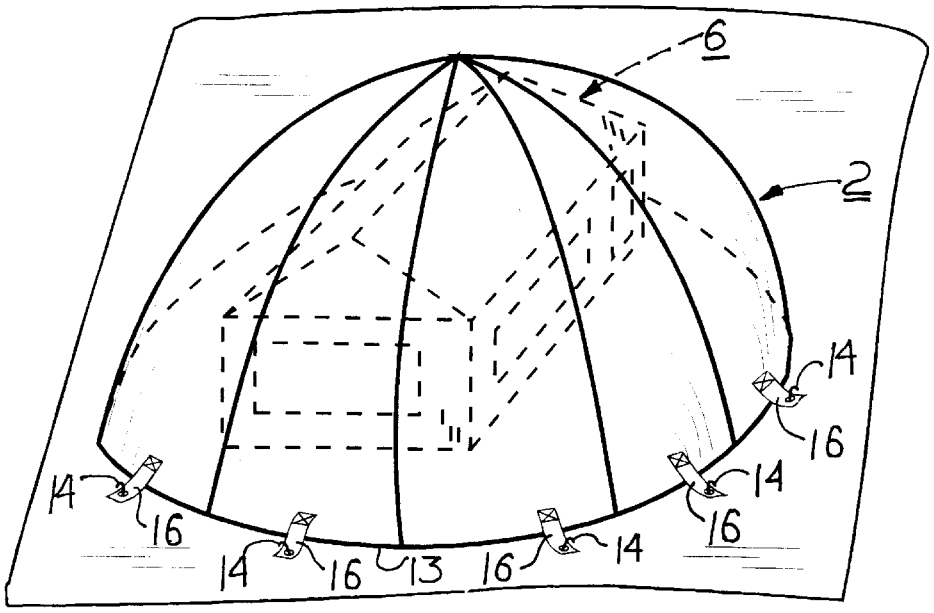
Fig. 11

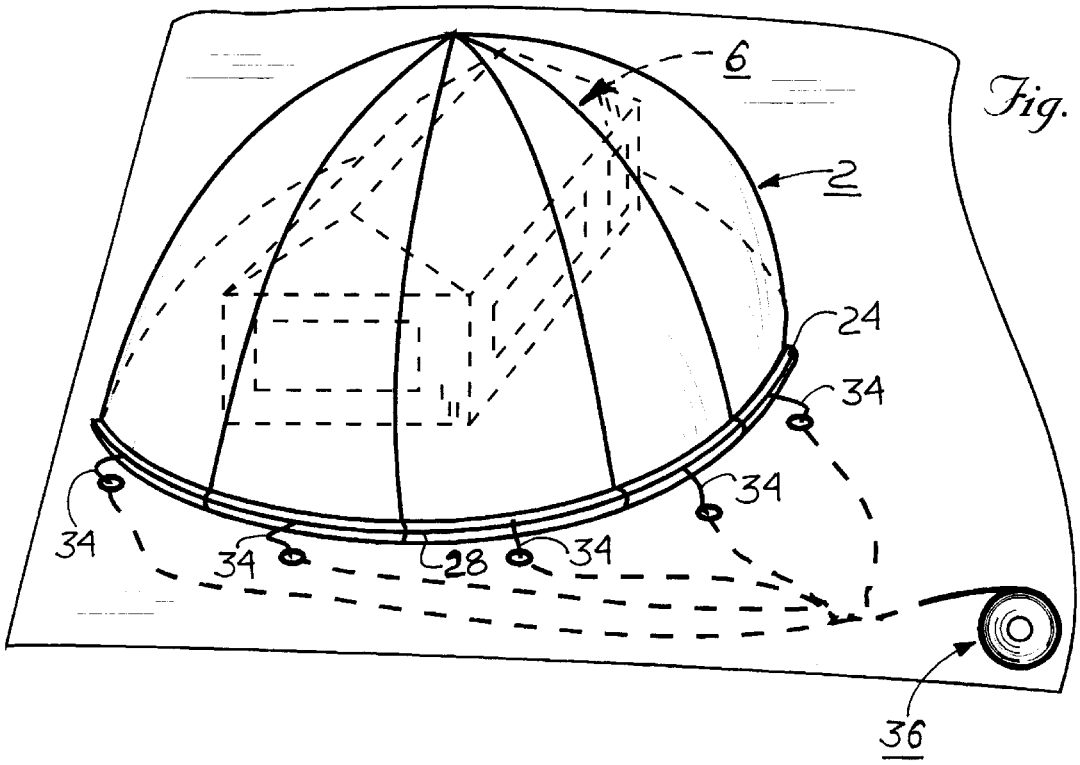
Fig. 16
Fig. 18
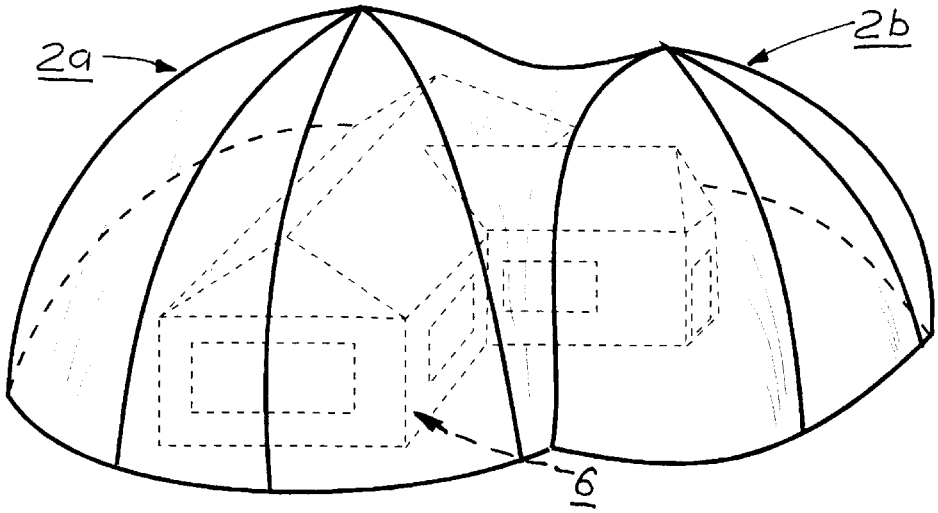

RAPIDLY DEPLOYABLE FIRE-PROTECTION APPARATUS

BACKGROUND OF THE INVENTION

1. Field of the Invention

This invention relates to an apparatus for protecting structures, as well as other objects, people and livestock from hazardous conditions, especially fire. In particular it relates to the design of an apparatus for emergency deployment in the event of the approach of hazardous conditions, especially rapidly moving fires commonly referred to as "fire storms."

Such fire storms, fueled by natural vegetation, debris and other sources create intense heat and severe convective air movement. As such, they create their own wind, rapidly drawing in air which in turn feeds the fire storm. Such fire storms cause millions of dollars in property damage every year, yet little has been done to proactively protect man-made structures. The present invention relates to protecting structures such as buildings, goods, livestock, persons and other objects from hazardous conditions, especially "fire storms."

2. Objects of the Invention

The principal object of this invention is to provide a means for protecting valuable property and/or lives from approaching fires, notably rapidly-moving forest and brush fires, commonly referred to as "fire-storms." More particularly, the present invention relates to a design for fire-resistant fabric structures deployed over buildings, other objects, livestock or people when confronted with an approaching fire.

It is an additional object of this invention to provide a means to rapidly cover a man-made structure with at least one layer of fire-resistant fabric while maintaining an air space between the protected structure and the fabric.

It is an additional object of this invention to provide a convenient storage method for the protective device.

It is yet another object of this invention to provide for rapid deployment of the protective device by a single person, if necessary.

It is yet another object of the present invention to provide a method for securing said apparatus to the ground thus providing a seal against the entry of hot air, flame, sparks, burning debris or other hazardous material.

It is yet another object of this invention to provide a method of maintaining the integrity and support of said apparatus under harsh wind and fire conditions, and in the event of a power failure.

It is yet another object of this invention to provide a method for maintaining at least a minimum air gap between said apparatus and the underlying structure being protected even in the eventuality that said apparatus should lose its structural support and collapse onto the underlying structure.

It is yet another object of this invention to provide an arcuate shape to the exterior surface of the protective apparatus to maximize laminar flow characteristics of air moving over the surface thus minimizing the entrainment of burning debris or sparks, and reducing the effects of wind and hot air, or other hazardous conditions.

3. Description of the Related Art

Strategies to protect structures from external fires are diverse. Nevertheless, millions of dollars in damage are caused, and many lives are lost every year by fire-storms and other rapidly moving fires which consume valuable real estate in their paths. Prior approaches to deployable fire protection devices depended primarily on unfurling curtains or thin sheets made of fire-retardant material to protect buildings from "sparks and flame." (See e g. Rhoads U.S. Pat. No. 2,365,127; Ballinger U.S. Pat. No. 3,715,843; and Mitchell U.S. Pat. No. 3,766,958). Such devices have several important drawbacks. Notably they are difficult and time-consuming to deploy and provide little or no insulating air space between the apparatus and the structure being protected. Temperatures in a fire-storm can reach in excess of the ignition point for wood and other combustibles. Therefore, maximizing the thermal barrier provided by an air gap is essential. The time and effort required to deploy a fire-protection device is critical since in the face of an approaching fire-storm, evacuation of people necessarily takes precedence over the protection of structures. The easier and faster the deployment, the higher the likelihood that the apparatus will be successfully used. Additionally, the faster such a device is set-up, the quicker people can be evacuated, thereby increasing the safety margin. Therefore the present invention represents a significant improvement over prior art.

BRIEF SUMMARY OF THE INVENTION

The present invention achieves the above-referenced objects by providing an inflated dome-like structure fabricated out of fire-resistant fabric. Several design alternatives are presented related to the structural support design. In its preferred embodiment, the fire protective structure is supported either by means of gas pressure entrained either in tubular ribs axially arranged, or by differential gas pressure in the interior volume of the structure itself. An alternative embodiment of the present invention utilizes two or more layers of fire-retardant fabric separated with air spaces. Such spaces may be pressurized to provide structural support to the protective structure. Several methods are available to provide pressure to maintain structural integrity of the protective structure including pressurized gas stored in tanks, fans, compressors and chemical reaction. Optionally, mechanical support ribs may be employed to supplement the pressure-support system. Additionally, sewn-in pleats or folds may be incorporated into the fabric construction so as to maintain a minimum of air space between the fire protective structure and the underlying protected object (usually a building structure) in the event of collapse of the protective structure.

BRIEF DESCRIPTION OF THE DRAWINGS

FIGS. 8A and 8B are cross-sectional views of the storage container in shut and open state.

FIG. 10 is partial sectional view of one of the protective struts.

FIG. 11 is perspective view of the protective structure being anchored to ground.

FIG. 12 an 13 are partial perspective views of the webbed straps used for anchoring the protective structure.

FIG. 16 is a perspective view of the protective structure being anchored to ground by cables with take-up mechanism.

FIG. 18 is a perspective view of the structure with compound dome shape.

DETAILED DESCRIPTION OF THE INVENTION

Figure 1:
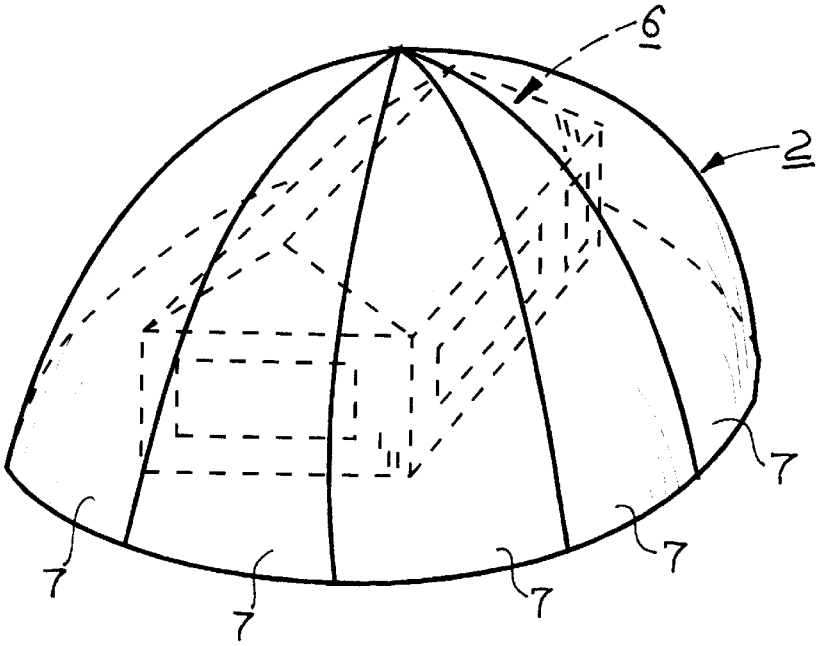
FIG. 1 is a perspective view of the protective structure in deployed state covering a dwelling.
Figure 2:
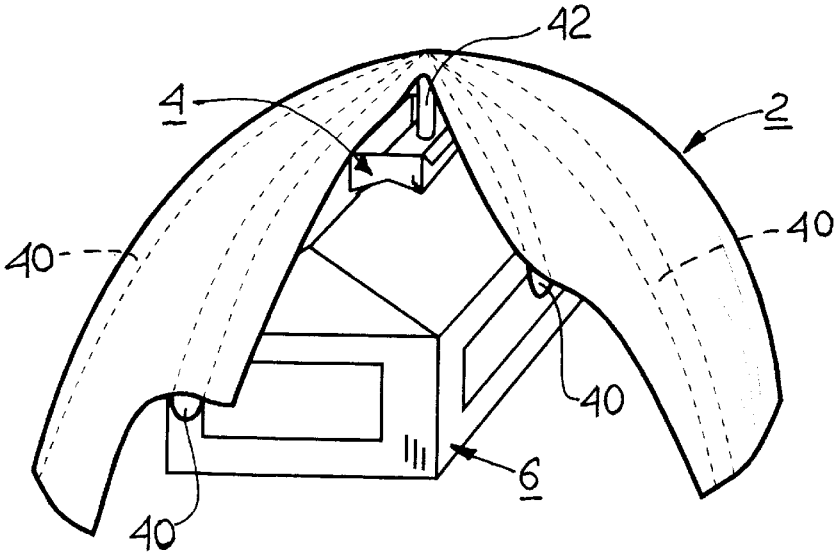
FIG. 2 is a partial sectional view of a deployed protective structure showing inflatable tubular supports
Figure 3:
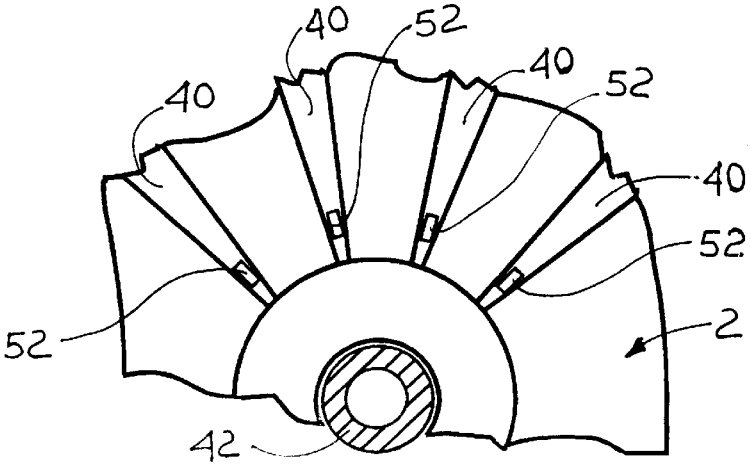
FIG. 3 is a partial plan view of the structure showing central inflating chamber and plurality of one-way valves leading to tubular supports.
Figure 4:
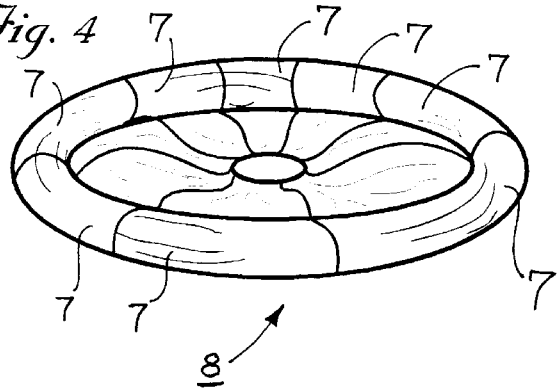
FIGS. 4 and 5 are perspective views of the protective structure being folded for storage
Figure 5:
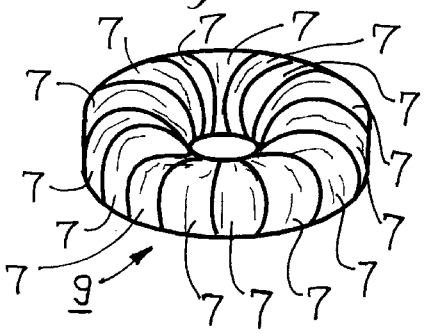
Figure 6:
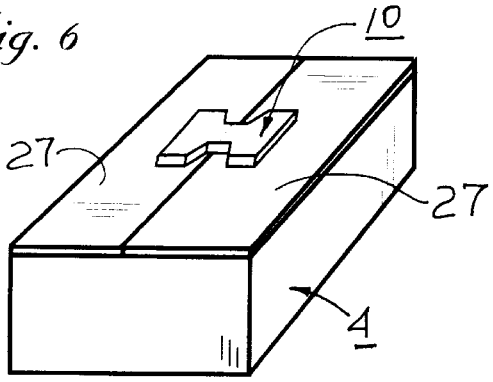
FIGS. 6 and 7 are perspective views of the storage container utilizing different locking elements.
Figure 7:
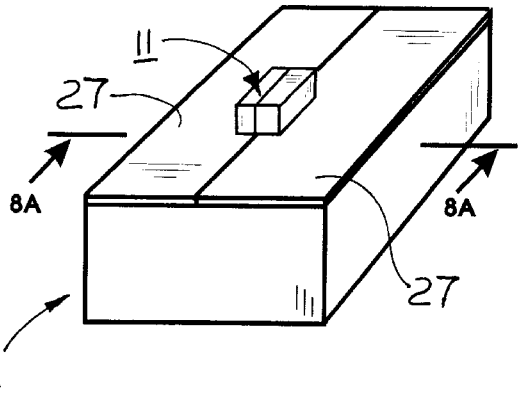
Figure 8A:
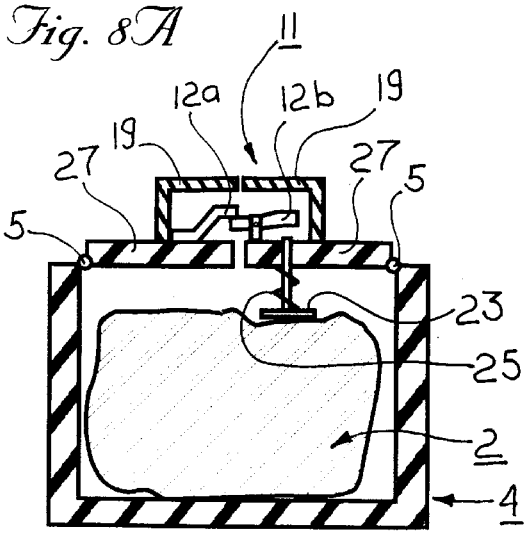
Figure 9:
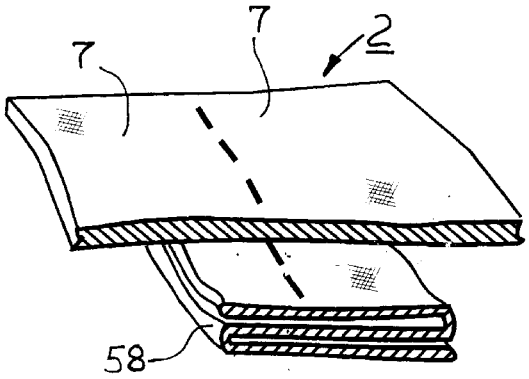
FIG. 9 is partial sectional view of one of the protective pleats.
Figure 13:
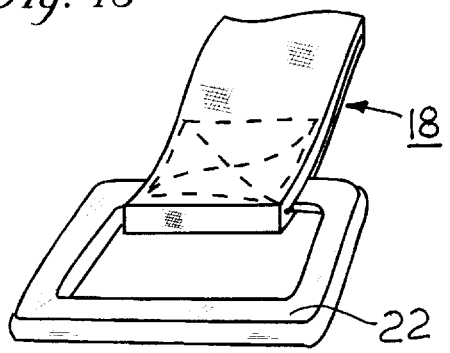
Figure 17:
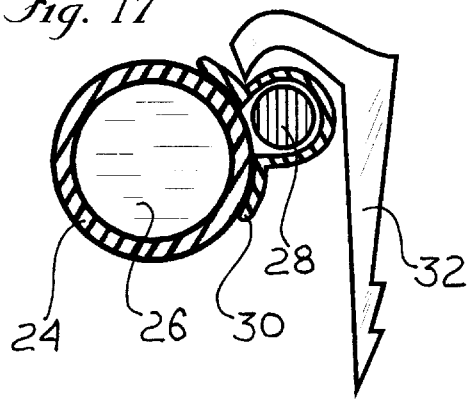
FIG. 17 is partial sectional view of the liquid-filled ballast and sewn-in anchoring cable.

In its preferred embodiment, the present invention is essentially a flexible dome structure 2 made of fire-resistant flexible material, such as Nomex®, Aramid® fabrics or impregnated variations and composite laminations of designs well-known to those skilled in the art. It is not the intent of this invention to specify or limit the materials used to create the flexible structure as there are many well-known such materials. The flexible fabric structure is stored in a convenient place ready for rapid deployment when faced with an approaching fire or other hazard. Typically a storage container 4 holding the fabric dome is located on the roof of a structure to be protected 6.

The dome structure can be fabricated by well known methods, usually involving a combination of sewing, gluing, heat sealing, welding, taping or otherwise attaching a multiplicity of pre-cut shapes of the fire-resistant fabric to form the desired shape upon deployment. In its simplest form, a half sphere may be formed by adhering a series of nominally triangular shaped pieces of fabric 7 and then inflating it. More complex three-dimensional shapes are possible by combining a multiplicity of shapes of fabric 7. It is not the intent of this patent to claim methods of fabricating fabric domes, but merely to point out that the fabrication of such structures is well known in the art. Such fabric structures are commonly used to cover swimming pools, tennis courts, skating rinks, and the like.

Examples

In one configuration, a dome for a moderately-sized home is packed into a single container 4 and housed on the roof of the house 6. Normally the fabric dome is rolled up into a progressively smaller ring shape 8 until it is compressed into the smallest possible dimension 9. It is then compressed and/or folded into a storage container 4. When faced with an approaching fire or other hazard, the storage container 4 is opened and the dome 2 is inflated. In one configuration, the inflation force opens the storage container by means of mechanical closure links 10 designed to break at a specific force, or a latch mechanism 12 which unlocks when subjected to pressure from the expanding dome. Container 4 contains two hinged cover flaps 27 held shut by locking action of latch elements 12*a* and 12*b*, which are protected by covers 19. The unlocking plunger 25 is held against the folded dome 2 by spring 25. Upon initiation of inflation of dome 2 unlocking plunger 25 is pushed by the expanding dome 2 upward where it subsequently engages the latch element 12*b* and causes it to pivot, thus unlocking cover flaps 27. Cover flaps 27 moving by the pressure from the expanding dome 2 pivot around hinges 5 and open releasing the dome 2.

Figure 14:
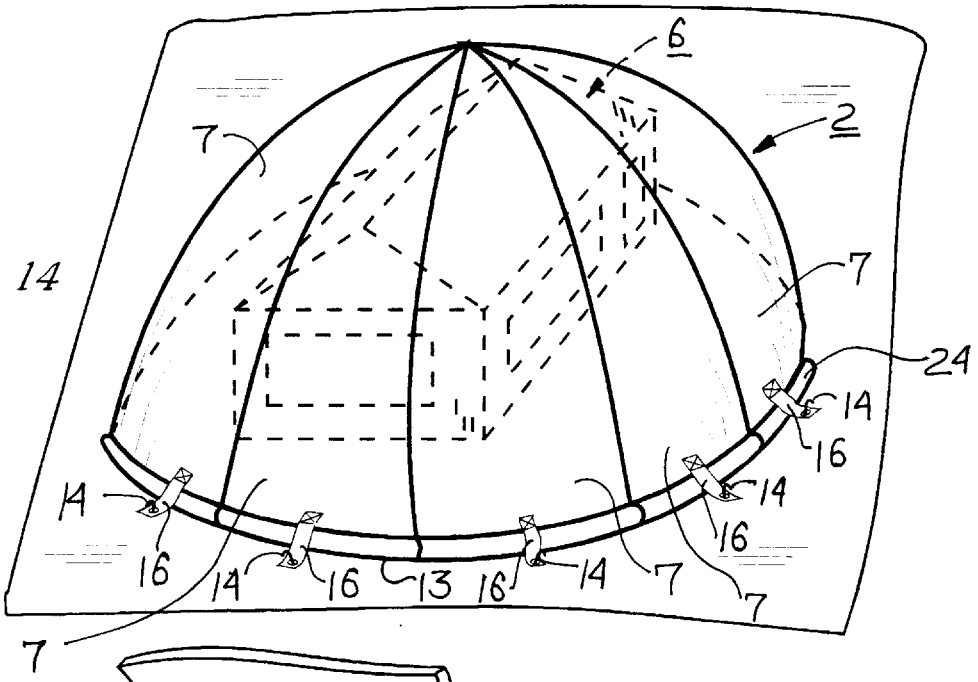
FIG. 14 is perspective view of the protective structure being anchored to ground by liquid-filled ballast.
Figure 15:
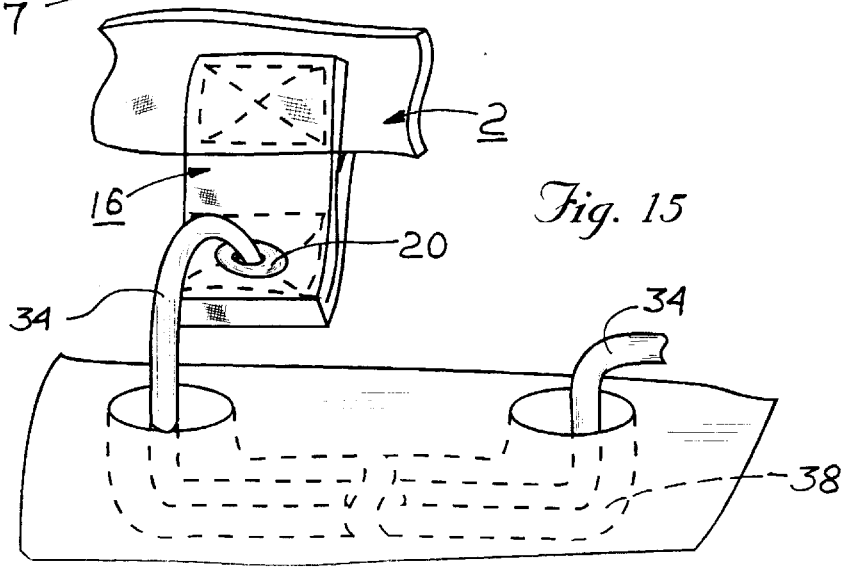
FIG. 15 is partial perspective view of concealed anchoring cable assembly.
Figure 19:
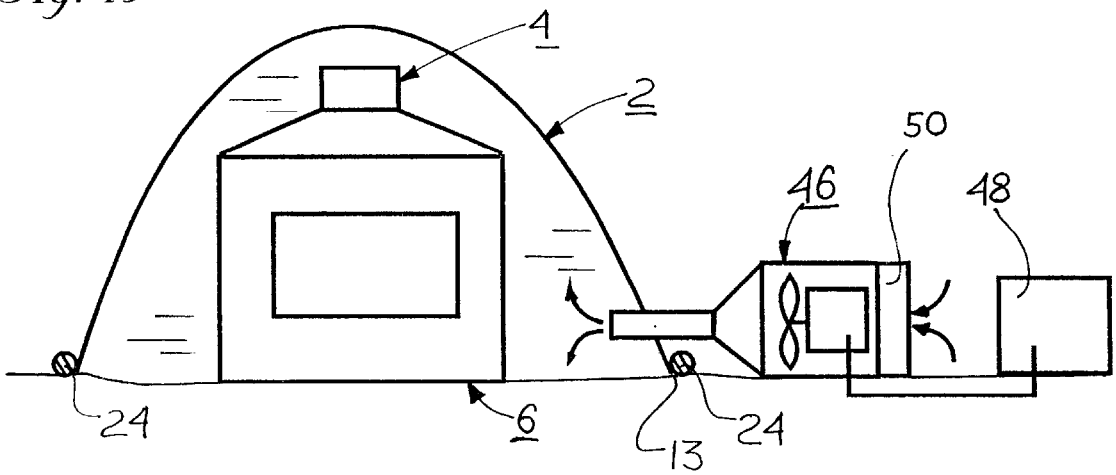
FIGS. 19, 20, and 21 are partial sectional views of several structure inflation configurations.

After being deployed over the house, the peripheral edge 13 contacting the ground is manually attached to pre-located anchors 14 at pre-defined intervals. The attachment points on the fabric are reinforced with such techniques as the use of webbed straps 1 with grommets 20, straps 18 with buckles 22, or combinations thereof An alternative design incorporates the weighing down of the peripheral edge 13 contacting the ground with a ballast reservoir 24 preferably filled with fluid 26. A combination of fluid ballast and ground anchors is considered the preferred embodiment due to the improved structural characteristics as well as the resultant improved ground contact seal as shown in FIG. 14.

While it is anticipated that manual attachment to the ground after inflation is the most cost-effective design, and generally adequate for the purpose intended, there are situations where automatic or mechanically-assisted engagement with the ground may be desirable. In such circumstances a mechanical engagement mechanism may be integrated into the peripheral ground-contacting edge and into the surrounding ground so as to facilitate automatic or semi-automatic engagement with the ground. Automatic filling of a tubular ground-contacting ballast reservoir 24 with water or other fluid 26 may replace or augment such an automatic ground engagement strategy. An example of an automatic ground engagement device would be a cable 28 sewn into a pocket 30 around the ground-contacting periphery 24 in combination with receiving clamps 32 located on the ground 2. Once the fire protective structure is fully inflated, the ground receiving clamps 32 engage said cable 28 and lock. The addition of a ballast reservoir 24 around the periphery adds strength and improves the ground seal.

Another example of an automatic ground engagement device is a series of cables 34 with one end attached to attachment points around the ground-contacting periphery of the dome structure 2, the other ends attached to one or a series of take-up mechanisms 36 on the ground around the periphery of the inflated dome. As the dome inflates, the cables become increasingly taut, ultimately securing the protective structure to the ground. While stored, the cables would be routed strategically via channels 38, which can be positioned underground to avoid interference with the use or aesthetics of the protected structure 2.

Several strategies may be employed for the support of the dome. In the preferred embodiment, a multiplicity of pressurized tubes 40 integral to the dome are radially disposed about the nominal central axis of the dome 2. The tubes may be inflated through a plenum 42*d* by means of a reservoir 44 of pressurized non-flammable gas such as an air, carbon dioxide or nitrogen. Alternatively, a mechanical air-moving device such as a fan or compressor 46 may be employed. Such a device should operate from an independent power source 48 such as an electric battery array or fuel cells to avoid deflation when power is disrupted. A fire-resistant screen/filter combination 50 is employed at the intake of the mechanical inflation device to protect it from fire and debris.

Figure 20:
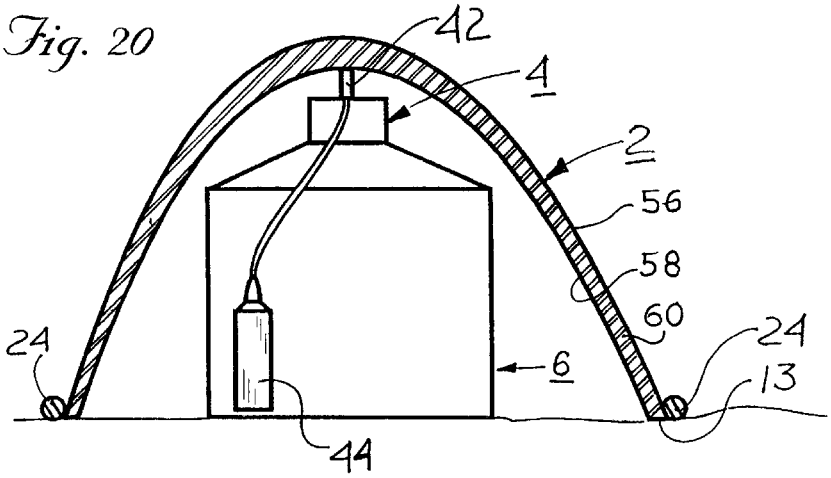
Figure 21:
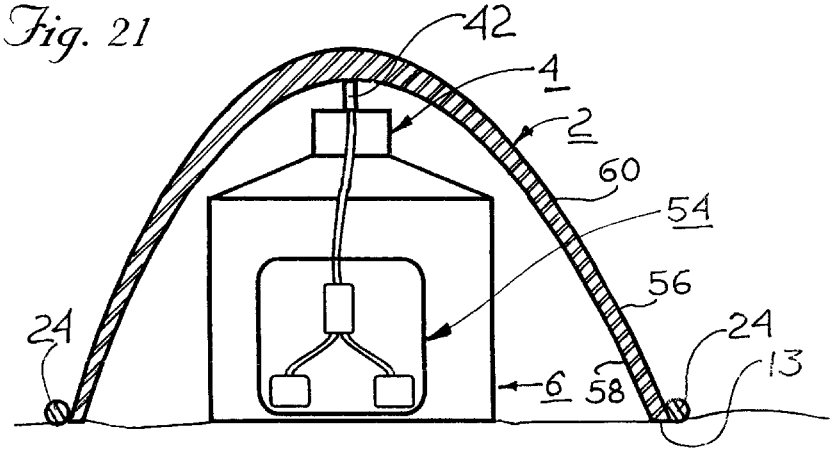

In another embodiment illustrated in FIGS. 20 and 21, two layers of fabric 56, 58 are used to form the dome 2. A pressurized fluid is forced in the air space 60 separating the two layers to deploy and impart rigidity to the structure.

In the event of a leak of the supporting gas in a single tube 40, one-way check valves 52 may be installed in such a way as to effectively isolate the leaking tube and maintain pressure in unaffected tubes.

An alternative source of pressurized gas may be by means of chemical reaction in a reactive chamber assembly 54. Chemical production of gaseous pressure is considered advantageous due to the long storage life of chemical reactants and the potentially low cost of such a strategy. Candidate chemical reactants are well known to those skilled in the art and no claim is made to the use of chemically-devolved gas under pressure.

Under certain circumstances, or to potentially reduce cost of the system, it may be desirable to use mechanical struts or ribs 56 to replace or augment pressurization strategies. While such struts interfere with the ability to compactly store the dome itself, they may be provided in a separate location for rapid manual insertion. Such struts may be composed of light-weight materials such as aluminum tubing or fiber-reinforced plastic (e.g. Fiberglas®) rods such as are commonly used in the field of tent design.

Additionally, in the event of diminishing or outright loss of pressure inside the structure 2, and its subsequent descent onto the house 6, a series of pleats 58 may be provided, preferably at the seams connecting structure sections 7. Pleats 58 would extend from apex of the structure 2 to its bottom and would provide stand-off space from the structure to the surface of the house, thus increasing fire-resisting capability of the structure 2 when supporting pressure inside it is diminished or lost altogether. Such pleats may be integral with the web straps 16 and 18 used to attach the protective apparatus to the ground. Additional pleats can be sewn onto the underside of structure 2 in various patterns, for example, a grid, to offer further protection.

It should be noted that the present invention need not take the form of a regular semi-spherical dome. Dome-like structures composed of intersecting sphere 2*a* and 2*b* sections may be required to protect irregularly-shaped buildings and other objects.

The apparatus is more fully disclosed by a description of its operation. When confronted by an approaching fire storm, the dome structure 2 is released from its storage container 4. The use of pressurized tubular structures 40 as described herein permit the opening of the structure much in the same way an inflated life raft may be deployed on a ship. As the dome inflates and envelops the house, the operator simply walks around the periphery and attaches hold-down points to pre-installed ground anchors 32. Water may also be added, manually or automatically, to the ballast reservoir 24 forming the ground-contacting edge 13 to aid in its ground-sealing properties. The operator may then be evacuated to a safer location.

While preferred forms of the invention have been shown in the drawings and described, since variations in the preferred form will be apparent to those skilled in the art, the invention should not be construed as limited to the specific form shown and described, but instead is as set forth in the following claims.

What is claimed is:

1. A device for protecting structures from fires comprising:

a. a dome-shaped fire-resistant fabric structure having an apex, one outer hemispherical surface, at least one inner surface and at least one ground-contacting peripheral edge, b. means for supporting said fabric structure in a substantially stable shape in windy conditions, c. means for storing said fabric structure in a rolled-up configuration around its apex for rapid deployment, d. fluid pressure-driven means for rapidly deploying said fabric structure, and e. means for rapidly securing said ground-contacting edge to said ground;

wherein said fire resistant fabric structure comprises a multiplicity of layers of fabric separated by air spaces.

2. The structure of claim 1 wherein said air spaces are pressurized.

3. A device for protecting structures from fires comprising:

a. a dome-shaped fire-resistant fabric structure having an apex, one outer hemispherical surface, at least one inner surface and at least one ground-contacting peripheral edge, b. means for supporting said fabric structure in a substantially stable shape in windy conditions, c. means for storing said fabric structure in a rolled-up configuration around its apex for rapid deployment, d. fluid pressure-driven means for rapidly deploying said fabric structure, and e. means for rapidly securing said ground-contacting edge to said around;

wherein said supporting means comprises at least one pressurized gas-filled chamber.

4. A fire-protection device as recited in claim 3 wherein pressurization of said chamber is provided from a reservoir of compressed gas.

5. A fire-protection device as recited in claim 3 wherein pressurization of said chamber is provided by mechanical pressurization means.

6. A fire-protection device as recited in claim 5 wherein said mechanical pressurization means is a fan.

7. A fire-protection device as recited in claim 5 wherein said mechanical pressurization means is an air compressor.

8. A fire-protection device as recited in claim 3 wherein pressurization of said chamber is by chemical reaction means.

9. A fire-protection device as recited in claim 3 further incorporating pleats in said inner surface of said fabric structure spaced close enough together to provide an air gap between said inner surface of said fabric structure and an outer surface of said protected structure when said structure is not supported or is otherwise in contact with said protected structure.

10. A fire-protection device as recited in claim 3 wherein said securing means comprises at least one fluid-filled ballast compartment attached to said ground-contacting surface.

11. A fire-protection device as recited in claim 10 wherein said fluid-filled ballast compartment is filled at the time said protection means is deployed.

12. A fire-protection device as recited in claim 11 wherein said fluid comprises at least some water.

* * * * *